United States Patent [19]

Clipper, Jr.

[11] 4,227,328

[45] Oct. 14, 1980

[54] DISPLAY DEVICE

[76] Inventor: Eddie L. Clipper, Jr., 686 Lafayette Ave., Brooklyn, N.Y. 11216

[21] Appl. No.: 927,387

[22] Filed: Jul. 24, 1978

[51] Int. Cl.[3] ..... G09F 19/00

[52] U.S. Cl. ..... 40/530; 40/594; 402/73; 402/502

[58] Field of Search ..... 40/530, 594, 611, 405, 40/533, 536, 537, 388, 390, 405; 35/35 E, 48 A; 46/DIG. 1; 402/70, 73, 74, 78, 502, 3

[56] References Cited

U.S. PATENT DOCUMENTS

| | | | |
|---|---|---|---|
| 1,329,910 | 2/1920 | Lambert | 402/70 X |
| 1,426,631 | 8/1922 | Hachmann | 40/530 X |
| 1,656,217 | 1/1928 | Miller et al. | 40/530 X |
| 1,659,395 | 2/1928 | Douglas | 402/70 |
| 2,093,160 | 9/1937 | Steinthal | 40/530 |
| 2,542,754 | 2/1951 | De Vry | 40/530 |
| 2,568,131 | 9/1951 | Segal | 402/70 |
| 3,276,145 | 10/1966 | Schade | 35/35 E |
| 3,316,669 | 5/1967 | Nachbar | 46/DIG. 1 |

FOREIGN PATENT DOCUMENTS

| | | | |
|---|---|---|---|
| 2448999 | 4/1966 | Fed. Rep. of Germany | 402/70 |
| 461433 | 10/1968 | Switzerland | 402/73 |

*Primary Examiner*—John F. Pitrelli
*Assistant Examiner*—G. Lee Skillington

[57] ABSTRACT

The invention discloses a display device of the type which opens up like a book having a first display side and a second display side, a flexible backing means connects the first and second sides and permits the first side to fold over the second side. An upstanding wall portion runs along the outer edge portions of the second side and forms a receptacle therewith. A plurality of picture storing elements are attached to said backing means and permit rotation of the picture storing elements into and out of the receptacle or onto the first side. Fastening means are fixed to the first side for enabling attachment of display elements to the fastening means on the first side, and further fastening means are fixed to the second side for enabling attachment of display elements to the fastening means on the second side.

7 Claims, 4 Drawing Figures

DISPLAY DEVICE

FIELD OF THE INVENTION

The present invention relates generally to a display device and, more particularly, it relates to a presentation album which may be used by artists, actors, and professional singers when attending interviews or auditions.

BACKGROUND OF THE INVENTION

For a successful interview it is essential among others that the artist or professional singer could present evidence of his past professional activity which should be readily available during the interview or audition at his fingertips.

Artists have been accustomed, in the past, to carry such "evidence" of their professional past in a briefcase or in an envelope in a random fashion from which usually nothing can be retrieved at the right moment or, they are retrieved in a crumpled fashion which one rightfully can expect when newspaper clippings are mixed up with records, cassettes or large size photographs.

SUMMARY OF THE INVENTION

It is, therefore, an object of the present invention to provide a display album which provides the possibility of organizing the various evidences of past professional activity in an excellent fashion, and all the materials stored in the display device can be readily retrieved, the display device offering an overall view of practically all the material contained therein and storing same in a readily retrievable and space-saving fashion and, at the same time, preserving the quality of the material.

It is another object of the present invention to provide a display device of the above type in which a plurality of storage elements are provided in a removable and interchangeable fashion providing additional capacity or interchangeability for various display elements.

Briefly, the invention provides a display device of the type which opens up like a book having a first display flap and a second display flap connected by a flexible backing means permitting the first flap to fold over the second flap. An upstanding wall portion runs along the outer edge portions of the second flap and forms a receptacle therewith, while a plurality of picture storing elements are attached to the backing means and permitting rotation of the picture storing elements into and out of the receptacle or onto the first flap. Fastening means fixed to the first flap enable attachment of display elements to the fastening means on the first flap, and further fastening means are fixed to the second flap for enabling attachment of display elements to the fastening means on the second flap.

BRIEF DESCRIPTION OF THE DRAWINGS

The invention will become more readily apparent from the following description of a preferred embodiment thereof shown, by way of example, in the accompanying drawings, in which.

DESCRIPTION OF THE PREFERRED EMBODIMENT

Figures 1, 4:
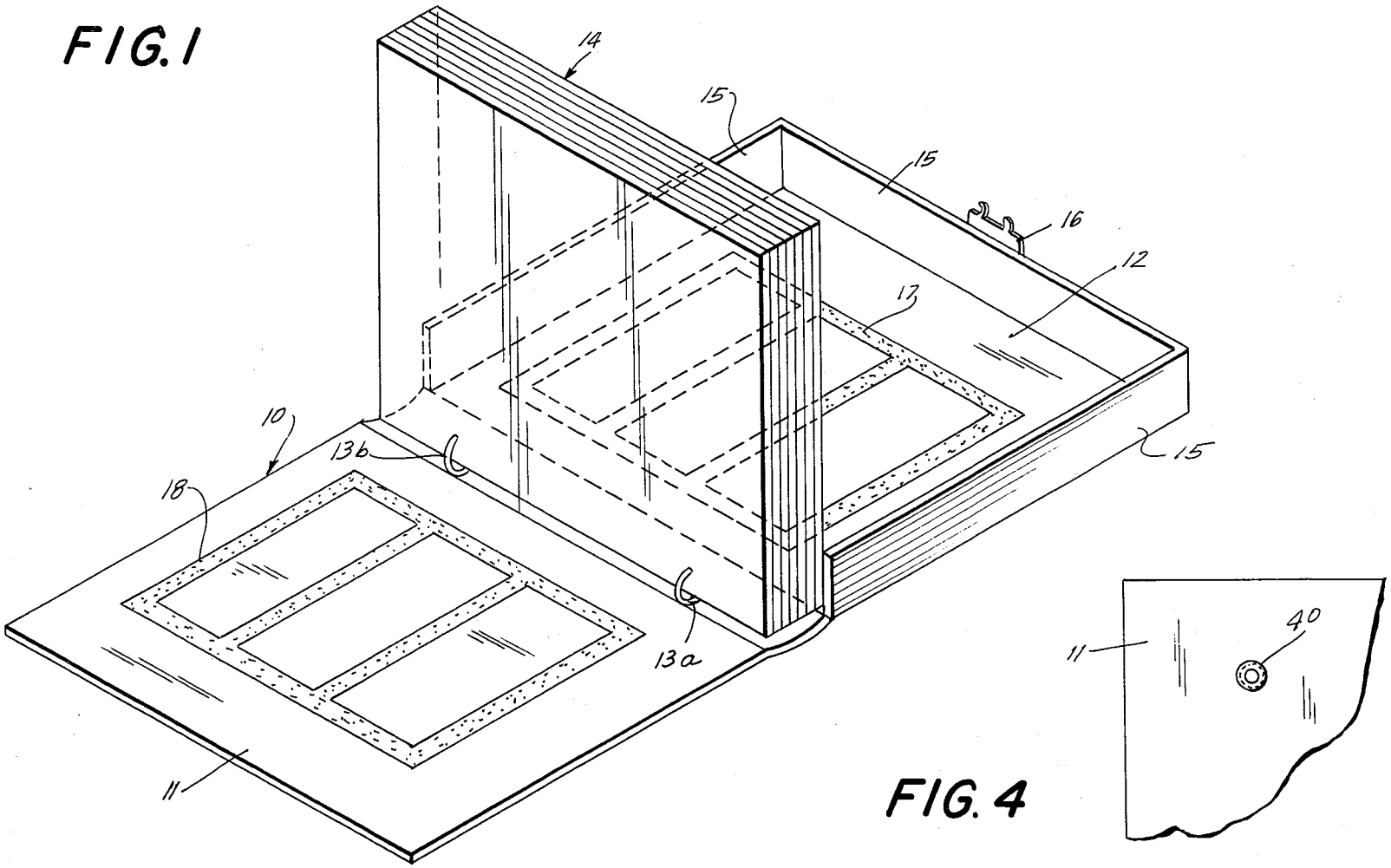
FIG. 1 is a schematic illustration of the unfolded display device according to the present invention with the attachable display elements removed.
FIG. 4 is a section in part of one of the sides of the unfolded display device similar to FIG. 1 showing an alternate way of attaching the display element to the inside of the display device.

With reference to FIG. 1, it is seen that the book-like display device 10 according to the present invention has a left major side 11 in its unfolded position, and a right major side 12 in its unfolded position connected together by a flexible backing material 13 which is well-known in the book binding art. The backing material can be a spiral spring which at the same time secures the picture storing elements 14 in place. It is noted that when the display device is in its folded portable position, then the side 12 serves as a bottom or receptacle part, as hereinafter described, for the picture storing elements 14 and also serves as a support for the top side 11 which folds on the top of it.

Figure 2:
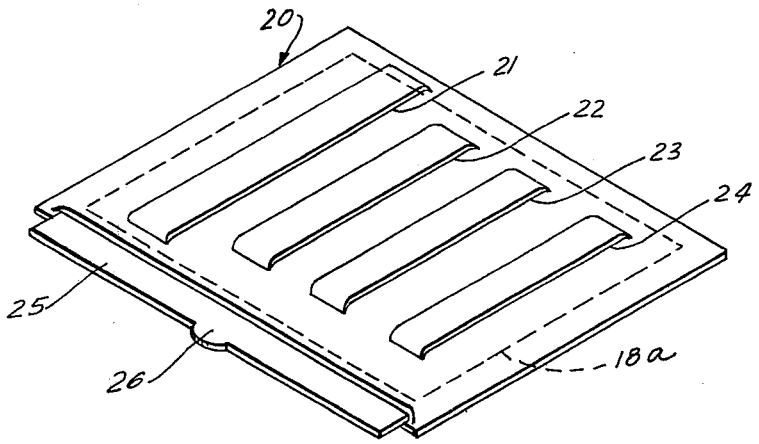
FIG. 2 is a schematic illustration of one of the attachable display elements.

The right side 12 which is the receptacle part of the display device in the folded position, has an upstanding wall portion 15 formed thereon along the three outer sides thereof with a height to accommodate the display elements illustrated and described in connection with FIGS. 2 and 3 therein and, at the same time, to receive the plurality of picture storing elements 14 when in the folded position. Also, the wall portion 15 is designed to have a height in order to receive additionally the display elements which are attached to the left side 11 when folded onto the receptacle side 12 and which elements have a certain physical height described in connection with FIG. 2. As a result, when the entire display device 10 is in its folded position, it presents the impression of a book, the upstanding wall portion 15 defining the thickness of the book and serving as an equivalent of the multitude of pages in a book. The upstanding wall portion 15 on its outer side can have decorations which resemble the pages of a closed book with additional shadings thereon. A specially designed tab 16 can be used for locking the display device.

Each the left side 11 and also the right side 12 of the display device 10 contain around the major side thereof at least, and also preferably crosswise between the major sides, a plurality of Velcro strips around it which are well-known in the art to serve for the rugged attachment of different objects without the use of sticky adhesive materials.

As hereinafter described in connection with FIGS. 2 and 3, the backside of the display elements are provided also with mating Velcro strips so that they can be attached to the strips 18 and 17 on the sides 11 and 12.

The plurality of picture storing elements 14 are made from transparent synthetic material and well-known in the picture album art and are loosely held together with either metallic rings 13*a* and 13*b* or similar equivalent elements in a fashion so that they can be removed and turned at will.

With reference to FIG. 1, it is noted that the flat display element 20 comprising two rectangular sheets sealed along three sides indicated therein contains a plurality of pockets on a first level which are accessible through crosswise running windows 21–24 which can serve for the insertion of various materials, such as resumes, awards, references or future engagements, notes, etc. The back of the display element 20 has an additional pocket provided therein on a second adjacent level which can be used for the storing of larger papers, such as diplomas indicated at 25 which are placed in a plastic cover which has a removing tab 26 on it. As mentioned above, the back of the individual display element 20 is provided with a mating Velcro strip 18*a* in order that the element 20 could be readily attached to the Velcro strip 18 on the side 11.

Figure 3:
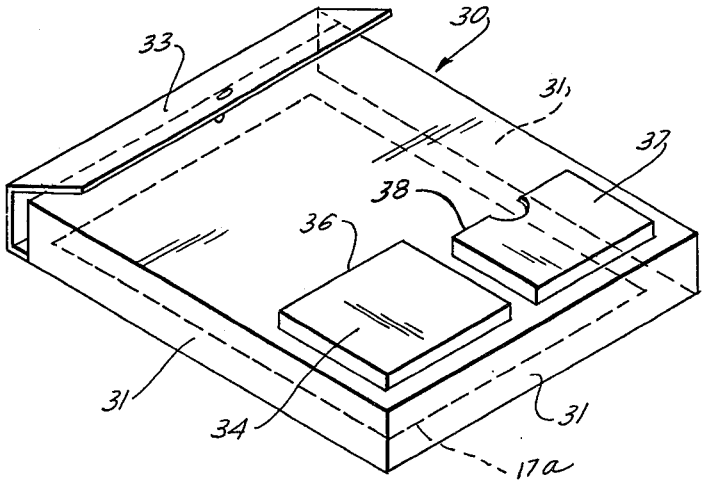
FIG. 3 is a schematic view of another one of the attachable display elements.

With reference to FIG. 3, it is noted that it illustrates a composite display element 30, 34, 37 which has a box-like configuration 30 having upstanding walls 31 defining the thickness of the box and which has an access on the top, coverable by a movable flap 33. Such box 30 can be readily used for storing of demonstration records of smaller size or cassettes.

The display box 30 has on its backside also Velcro strips 17*a* attached which will mate with the Velcro strip 17 on the side 12 and attachable thereto.

Additional display elements are illustrated at 34 and 37 which are in addition attachable to the top of the box 30 and have access opening respectively indicated at 36 and 38 and can serve for the storing of smaller items of interest, such as smaller photographs or social security cards, union cards, etc. The smaller display elements 34 and 37 have Velcro strips attached to their back so that in turn could be attached to similar Velcro strips provided on the box 30.

With reference to FIG. 4, it is seen in partial section that the sides 11 and 12 can be provided with other types of fastening means, such as snaps 40, instead of the Velcro strips. It is within the scope of the invention that all detachable display elements herein before discussed can be attached with snaps to the sides 11 and 12 instead of the Velcro strips, wherever, therefore, Velcro strips are mentioned they are equivalently replaceable with snaps or other fastening elements.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A display, for holding picture storing elements, of the type that opens like a book comprising:

a first rectangular display side;

a second rectangular display side;

a rectangular backing side having one edge flexibly connected to one edge of the first side and the parallel edge of the backing side flexibly connected to one edge of the second side;

a wall portion attached to the three edges, of the second side, that are not connected to the backing side, said wall being perpendicular to the plane of the side whereby the wall and sides form a closed receptacle when the first side is folded over the second side;

means for attaching a plurality of picture storing elements to the backing side, said means for attaching are positioned such that the picture storing elements are within the receptacle when the first side is folded over the second side, said means of attaching permit rotation of the picture storing elements from a position atop the first side to a position atop the second side;

fastening means on the first and second sides for removably attaching display elements to the first and second sides, such that the display can be within the closed receptacle;

the display element attached to the first side comprising:

two rectangular sheets sealed along three sides whereby forming a storage pocket between the sheets;

and a plurality of pockets attached to the front sheet that is not fastened to the first side;

and the display element attached to said second side comprising:

a rectangular storage box;

and a plurality of pockets attached to the front face opposite to the face attached to the second side.

2. A display device as claimed in claim 1, wherein said fastening means are Velcro strip means.

3. A display device as claimed in claim 1, wherein a display element is attachable to said first side carries mating fastening means on the backside thereof.

4. The display device as claimed in claim 1, wherein the display element attachable to said second side carries mating fastening means on the backside thereof for attachment.

5. The display device as claimed in claim 1, wherein said fastening means are snap means.

6. The display device as claimed in claim 1, wherein said backing means is flexible.

7. The display device as claimed in claim 1, wherein said backing means is a ring means.

* * * * *